US005772804A

United States Patent [19]

Brown

[11] Patent Number: 5,772,804

[45] Date of Patent: Jun. 30, 1998

[54] METHOD OF PRODUCING ALUMINUM ALLOYS HAVING SUPERPLASTIC PROPERTIES

[75] Inventor: Kevin R. Brown, Pleasanton, Calif.

[73] Assignee: Kaiser Aluminum & Chemical Corporation, Pleasanton, Calif.

[21] Appl. No.: 521,364

[22] Filed: Aug. 31, 1995

[51] Int. Cl.[6] ..... C22C 21/00

[52] U.S. Cl. ..... 148/564; 148/564; 148/692; 148/691; 148/695; 148/696

[58] Field of Search ..... 148/564, 692, 148/691, 695, 696

[56] References Cited

U.S. PATENT DOCUMENTS

| | | | |
|---|---|---|---|
| 4,486,242 | 12/1984 | Ward et al. | 148/11.5 A |
| 4,486,244 | 12/1984 | Ward et al. | 148/12.7 A |
| 4,490,188 | 12/1984 | Bampton | 148/12.7 A |
| 4,528,042 | 7/1985 | Ward et al. | 148/11.5 A |
| 4,618,382 | 10/1986 | Miyagi et al. | 148/415 |
| 4,645,543 | 2/1987 | Watanabe et al. | 148/2 |
| 4,659,396 | 4/1987 | Lifka et al. | 148/11.5 A |
| 4,770,848 | 9/1988 | Ghosh et al. | 148/564 |
| 4,830,682 | 5/1989 | Ashton et al. | 148/11.5 A |
| 4,867,805 | 9/1989 | Agrawal et al. | 148/11.5 A |
| 5,122,196 | 6/1992 | Fernandez et al. | 148/552 |
| 5,160,388 | 11/1992 | Legresy et al. | 148/552 |
| 5,181,969 | 1/1993 | Komatsubara et al. | 148/552 |

OTHER PUBLICATIONS

"An Optimised Manufacturing Route for Superplastic 7475 Sheet", G. J. Mahon et al., Materials Science Forum vols. 170–172 (1994) pp. 187–192, 189.

Chem. Abs., vol. 115, No. 18, Abs No. 188127, Nov. 4, 1991 Superplastic Working of Aluminum Alloys; Tsuzuki, Takayuki et al.—Mitsubishi Heavy Industries, Ltd. Japan.

Chem. Abs. vol. 124, No. 20, Abs No. 267499, May 13, 1996 Properties of Superplastic 5083 alloy and its Applications; Matsuo M.—60 years Pearson, Proc. Conf. (1995) Meeting date 1994, 277–83, Inst. of Mat. UK.

*Primary Examiner*—David A. Simmons
*Assistant Examiner*—M. Alexandra Elve
*Attorney, Agent, or Firm*—Philip L. McGarrigle; Gerald D. Haynes

[57] ABSTRACT

A method of producing an aluminum alloy having superplastic properties, including the steps of: heating the aluminum alloy; hot rolling to an exit temperature ranging from about 650° to 70° F.; and cold rolling to a gauge corresponding to a percentage of cold work selected from among those falling within the zone defined by the lines joining the points of A (475° F., 10%), B (650° F., 99%), C (70° F., 99%) and D (70° F., 10%), shown in FIG. 2, showing the relationship between the temperature range of the hot rolling exit temperature and the percent of cold work.

15 Claims, 5 Drawing Sheets

METHOD OF PRODUCING ALUMINUM ALLOYS HAVING SUPERPLASTIC PROPERTIES

BACKGROUND OF THE INVENTION

1. Field of the Invention

The present invention relates to superplastic aluminum alloys. More specifically, the invention relates to a method for producing heat-treatable and non-heat treatable aluminum alloys having superplastic properties.

2. Description of the Related Art

In most sheet metal forming processes, the plasticity of a metal is generally much less than fifty percent. This lack of plasticity limits the objects that can be made from the metal sheet and increases the number of forming steps needed to manufacture complex shapes. "Superplasticity" is a phenomenon in which a material has an exceptional ability of being elongated under special forming conditions to an extent of fifty to one thousand percent or more of its initial size, without breaking or necking. In general, the special forming conditions require high temperatures and slow forming rates. Metal sheet that has improved superplastic properties, however, allows lower temperatures and faster forming rates.

To achieve superplasticity, it is necessary, but not always sufficient, to have very fine grain sizes from for example, 0.1 or less to about 15 microns. Generally, the finer the grain size, the better the superplastic properties.

Workers in the field have utilized superplastic forming most commonly for titanium alloys and aluminum alloys for several decades. They developed a number of processes to make commercial aluminum alloy sheet fine grained and superplastic, but these processes generally require special and expensive processing steps such as cross rolling, a separate solution heat treatment and quenching operation, and/or very high degrees of cold rolling that are difficult to achieve. Many of these processes require individual handling of sheets and plates, and are not amenable to commercial mass production.

For example, U.S. Pat. Nos. 4,486,242, 4,486,244 and 4,528,042, all to Ward et al. describe methods of using superplastic aluminum sheet wherein the sheet is subjected to certain thermomechanical processes and then recrystallized. Specifically, Ward et al. begin their processes with a solution heat treating step to dissolve the normally soluble phases and then hot roll between 600° and 700° F. followed by a cold rolling step. These references caution that hot rolling above 700° F. may produce a sheet product having a grain size greater than 20 $\mu$m which results in unsatisfactory superplastic properties. Also, the methods of Ward et al. are generally limited to heat treatable alloys.

Similarly, U.S. Pat. No. 4,618,382 to Miyagi et al., which also is directed to only heat treatable alloys, requires a mid-process thermal step of heating the alloy to above the heat treatment temperature.

U.S. Pat. No. 5,181,969 to Komatsubara et al., describes a process of obtaining superplastic properties in a non-heat treatable alloy consisting essentially of 2.0 to 8.0 wt. % magnesium, 0.3 to 1.5 wt. % manganese, 0.0001 to 0.01 wt. % beryllium, less than 0.2 wt. iron, and less than 0.1 wt. % silicon as impurities with the balance aluminum. This patent claims to obtain superplastic properties in this non-heat treatable alloy by heating, hot rolling and then cold rolling to a draft of at least 30%.

Thus, a need remains for a process of making both heat treatable and non-heat treatable alloys which have superplastic properties without using expensive thermal or mechanical processing steps and that is independent of the specific chemistry of the particular alloy. Accordingly, it is an object of this invention to provide such a process.

SUMMARY OF THE INVENTION

The present invention provides a method of producing an aluminum alloy having superplastic properties. It comprises the steps shown schematically in FIG. 1. of: heating the aluminum alloy; hot rolling to an exit temperature ranging from about 650° to 70° F.; and cold rolling to a gauge corresponding to a percentage of cold work selected from among those falling within the zone defined by the lines joining the points of A (475° F., 10%), B (650° F., 99%), C (70° F., 99%) and D (70° F., 10%), shown in FIG. 2, showing the relationship between the temperature range of the hot rolling exit temperature and the percent of cold work, thereby producing a non-heat treatable aluminum alloy capable of having superplastic properties.

In a preferred embodiment of the present invention, I can produce superplastic properties in heat treatable alloys where the method comprises the steps of: heating the heat treatable alloy; initial hot rolling; holding at a temperature and time period sufficient to create precipitates of intermetallic constituents having a diameter ranging from about 0.5 to 10 microns; hot rolling to an exit temperature ranging from about 650° to 70° F.; and cold rolling to a gauge corresponding to a percentage of cold work selected from among those falling within the zone illustrated in FIG. 2. The grain sizes referred to herein are those measured in the longest grain direction, which is the sheet rolling direction, and because grains are often elongated in the rolling direction, the sizes reported may be larger than the average grain size, or than sizes measured in other directions.

The foregoing and other objects, features, and advantages of the invention will become more readily apparent from the following detailed description of preferred embodiment which proceeds with reference to the drawings.

DETAILED DESCRIPTION OF THE INVENTION

The present invention describes a method of producing superplastic properties in conventional aluminum alloys by a process that utilizes conventional processing equipment and procedures, and therefore produces the sheet at significantly lower cost. Broadly stated, the alloys of the present invention can either be heat treated or non-heat treated aluminum alloys.

Preferred Process for Non-Heat Treatable Alloys

To illustrate a preferred embodiment of the present invention, I employ non-heat treatable alloys, such as those of the Aluminum Association ("AA") 3000 and 5000 series aluminum alloys. For example, my non-heat treatable alloy is AA 5083 and consists essentially of about 4.0 to 4.9 wt. % magnesium; about 0:4 to 1.0 wt. % manganese; not more than about 0.25 wt. % chromium; not more than about 0.4 wt. % iron; not more than about 0.4 wt. % silicon; and the balance aluminum. I heat and hot roll the alloy and then cold roll it to obtain an alloy capable of having superplastic properties. I have found that there is a very important relationship between the hot rolling exit temperature and the percent of cold work necessary to obtain the desirable superplastic properties.

Figure 1:
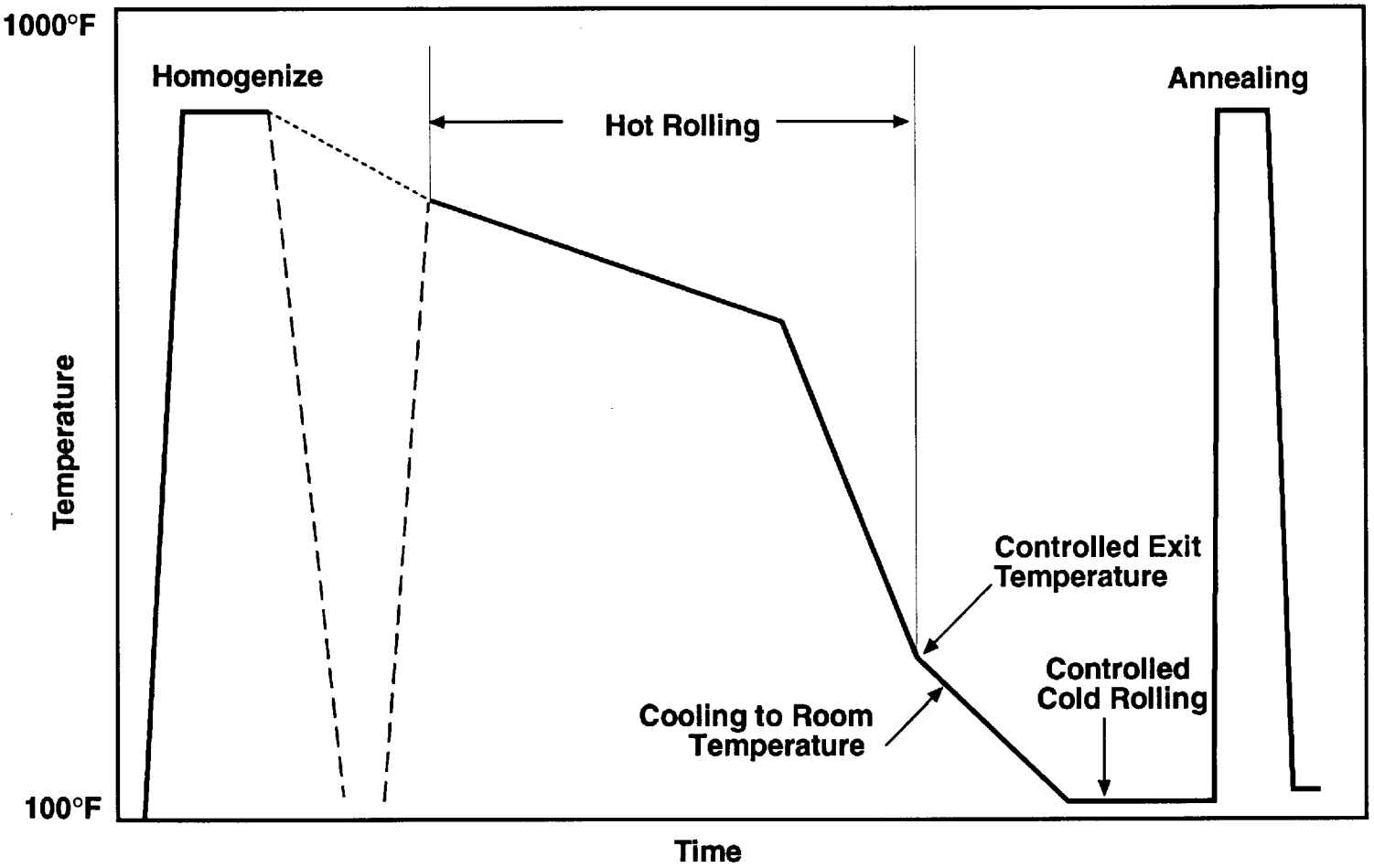
FIG. 1 is a graphic representation of the process according to the present invention.

The general time-temperature cycles necessary to accomplish my invention are shown in FIG. 1. The processing sequence comprises heating, optional cooling and reheating, hot rolling, and cold rolling. Optionally, I utilize a final anneal step to fully recrystallize the sheet to a fine grained microstructure. The correct combination of these steps, particularly the amount of cold rolling as a function of the hot rolling exit temperature, will produce a fine grained microstructure which is capable of exhibiting superplastic behavior at elevated temperatures. I will next describe these process steps which are depicted in FIG. 1 in more detail.

Heating Step

Initially, I take the stock in the form of a DC (direct chill) or continuously cast ingot and heat it to a temperature ranging from about 750° to 1100° F. for a period of from about 1 to 24 hours. Preferably, I use the temperature ranges and times normally used in the production of conventional sheet of the particular non-heat treatable alloy. This process is known in the trade as "homogenizing" or "preheating". For example, for an AA 5083 alloy, I soak the cast DC ingot at temperatures from 850° to 1050° F. for periods from about 4 to 24 hours.

Optional Cooling Step

After heating, I optionally cool the ingot to the rolling temperature, which ranges between about 700° to 950° F., either in the furnace, or by still or forced air cooling. Alternatively, I cool the ingot to room temperature and then reheat it to the hot rolling temperature. In general, I cool the ingot between about 20° and 100° F./hr Hot Rolling Step In general, I hot roll at initial temperatures ranging from about 700° to 950° F. The rolling of work hardenable alloys such as 5083, that do not produce significant volumes of precipitates during holding at these temperatures is not interrupted by an over aging step as preferred for heat treatable alloys as discussed below.

The metal is then hot rolled continuously to the desired gauge such that the metal is cooled rapidly, particularly in the later stages of hot rolling, and before the metal is coiled or stacked. This part of the process, which is an important part, uses concurrent precipitation and/or reduced temperatures of hot rolling to retain in the metal as much strain energy as possible, and to impede the loss of this energy by recrystallization and recovery. This is particularly important when the metal is coiled, usually at thicknesses between 0.5" and 0.05", as large coils cool much slower than uncoiled strip. A finishing or coiling temperature of less than 500° F., and preferably less than 450° F. is generally required.

Cold Rolling Step

I next allow the hot rolled coil to cool naturally, and then I cold roll it to final gauge. In general, I can cold roll the hot rolled sheet from 0 to 99%, either as coil or as individual sheets or plates to the desired gauge.

Figure 2:
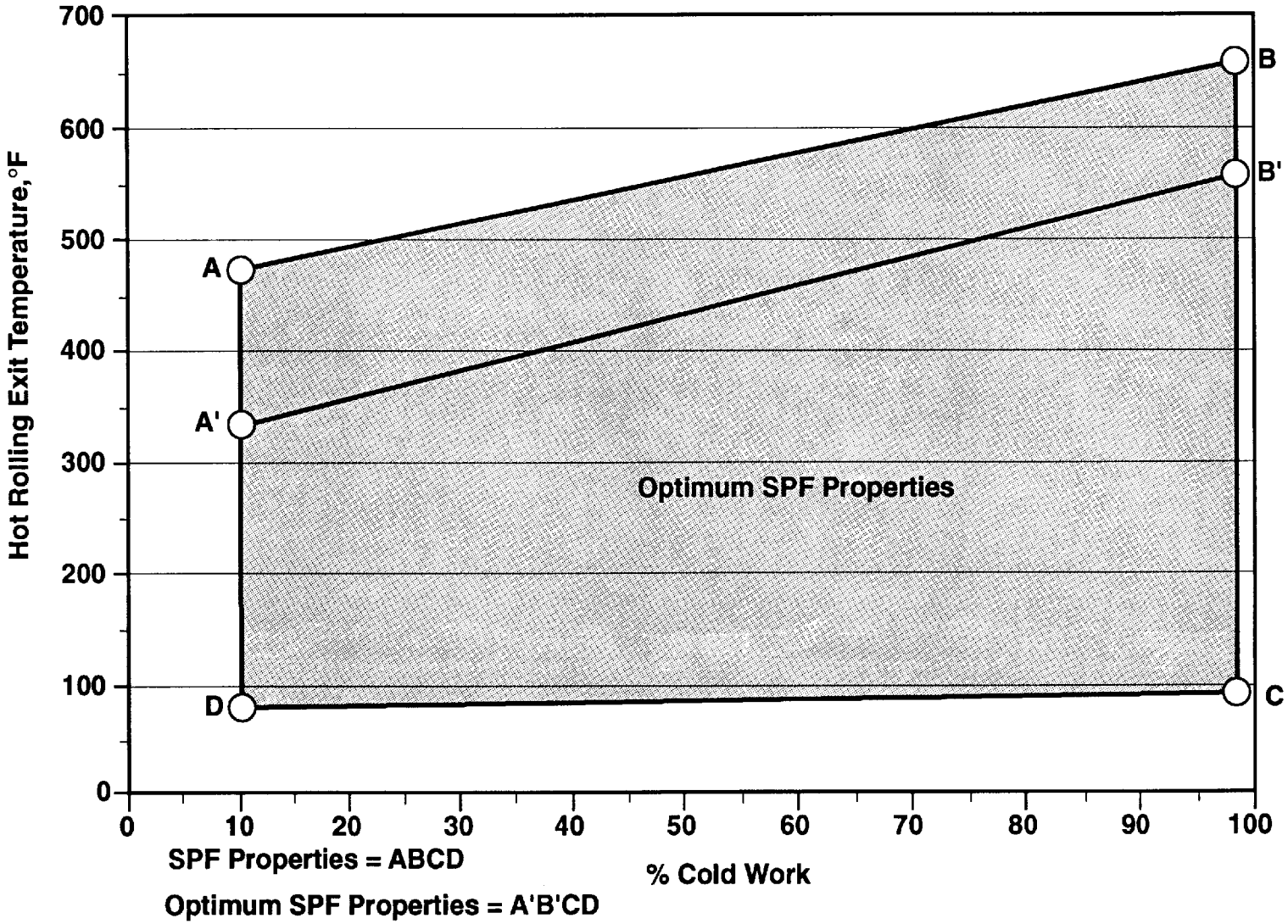
FIG. 2 is a graph showing hot rolling exit or finishing temperature as a function of percentage of cold work necessary to produce superplastic properties, according to the present invention.

Surprisingly, I have discovered that the amount of cold rolling required to produce superplastic properties in the final product may be a function of, or at least strongly dependent on the hot rolling exit or coiling temperature. I have determined that I obtain superplastic properties only by cold rolling to a gauge corresponding to a percentage of cold work which falls within the zone defined by the lines joining the points of A, B, C, and D as illustrated in FIG. 2. In addition, I have found that I obtain optimum superplastic properties when the amount of cold work falls within the zone defined by the line joining the points A', B', C and D. For most conventional hot rolling processes, however, 50% or more cold rolling is required to produce an annealed grain size below 10 to 15 microns, and to develop good superplastic properties.

A principal advantage of my process is that by discovering the relationship between hot rolling exit temperature and the amount of cold work, I can significantly reduce the amount of cold work necessary to obtain the desirable superplastic properties as compared to conventional processes. Unexpectedly, I have found that the relationship between the amount of necessary cold work and the hot rolling exit temperature is similar for both heat treatable and non heat treatable alloys.

Final Annealing

If I desire to produce an annealed or a solution heat treated product, in "O" or "T4" temper, it is necessary to again heat the coil, sheet or plate. As the final grain size, and hence the superplastic properties depend on the heating rate to the annealing or solutionizing temperature, it is advantageous to heat as rapidly as possible. When the above teachings are applied, the heating rates achieved in a stirred air furnace continuous annealing line are adequate, but more rapid heating, as in a salt bath, will further improve the product.

A requirement for fine grain size is that the annealing of the coil to be done as unwound strip so that sufficiently rapid heating rates to the annealing temperature are obtained. Because of the above prior treatments, stirred air heating of sheet or unwound strip is sufficient to produce grain sizes less than 10–15 microns, but finer grain sizes of 8 to 10 microns can be achieved consistently by using salt bath or other more rapid heating rate annealing processes.

The use of air heating permits using conventional aluminum sheet heat treatment lines, and enables the production of wide, continuously annealed or heat treated coils. The annealing may also be achieved incidentally during heating to the elevated forming temperature in a superplastic forming furnace. In this case, an "F" temper, unannealed product may be supplied by the producer, but the grain size and degree of superplasticity will be dependent on the heating rate in the forming furnace, but it will generally be superior to material produced in prior art processes using similar degrees of cold rolling.

Preferred Process for Heat Treatable Alloys

In an alternative embodiment of my invention, I can produce superplastic properties in heat treatable alloys such as AA 2000 and 7000 series alloys. I will illustrate this embodiment of my invention using a AA 7475 alloy that consists essentially of about 5.2 to 6.4 wt. % zinc, about 1.9 to 2.6 wt. % magnesium, about 1.2 to 1.9 wt. % copper, and 0.18 to 0.28 wt. % chromium.

Figure 3:
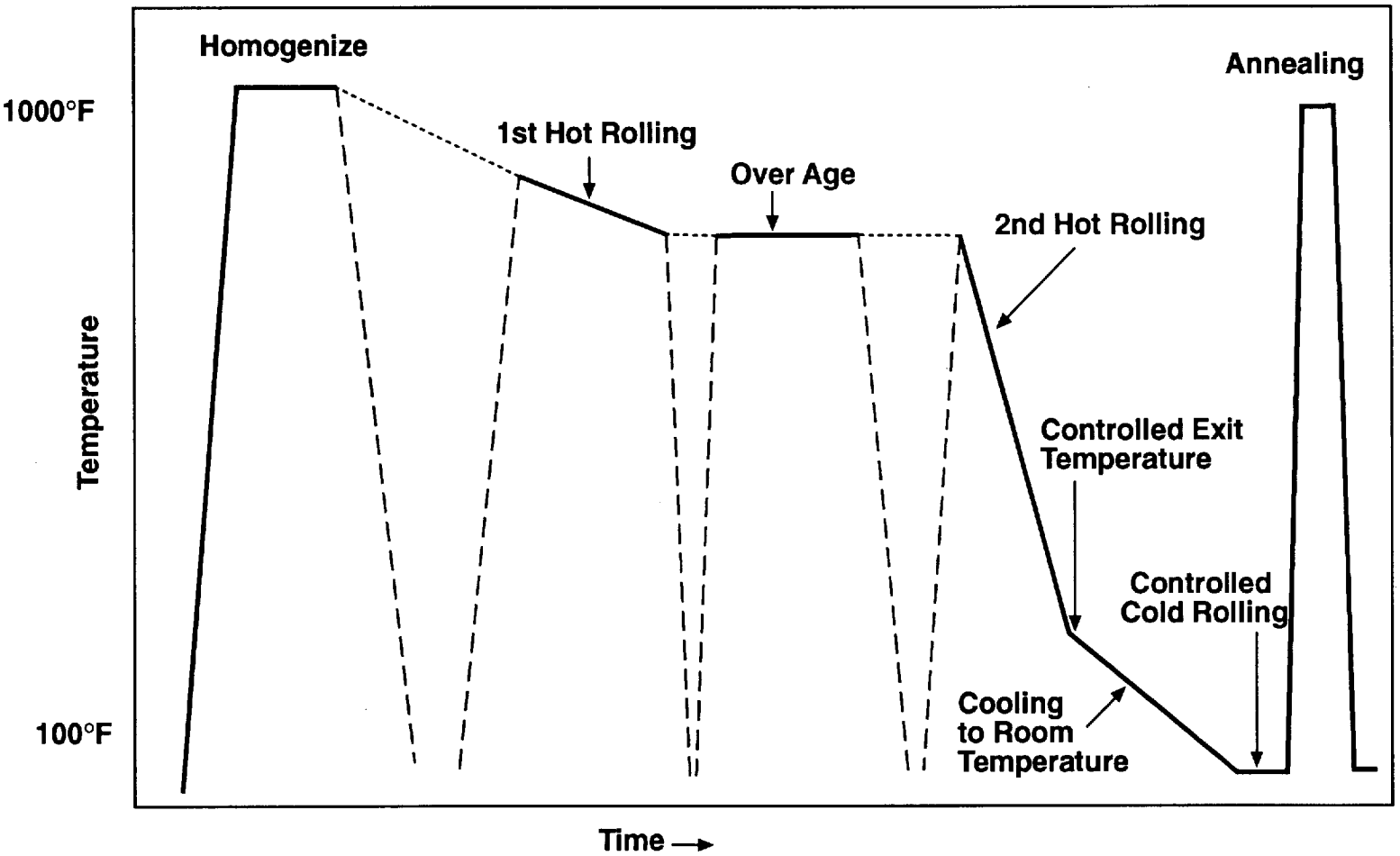
FIG. 3 is a graphic representation for a preferred process for producing superplastic properties in heat treatable alloys according to the present invention.

My preferred processing sequence for heat treatable alloys comprises heating, initial hot rolling, over aging, secondary hot rolling, cold rolling, and optional annealing. As with the non-heat treatable alloys, I first heat and then hot roll the heat treatable alloy. But then I introduce a holding period followed by a second hot rolling step before cold rolling. I will next describe these process steps which are depicted in FIG. 3 in more detail.

Initial Hot Rolling Step

After heating I cool the ingot directly to the rolling temperature or to room temperature and then reheat to the rolling temperature if this is desired. Preferably I use a rolling temperature that is used normally for the alloy being rolled and this is usually in the range 700° to 1000° F. I generally roll the alloy to a convenient thickness, typically in the range 2 to 9 inches.

Over Aging Treatment

In the case of the heat treatable alloys, I interrupt the hot rolling at this stage and then I either cool the slab to room temperature and reheat it or I place it directly in a furnace at 600° to 850° F. for about 1 to 24 hours. For alloys such as AA 7475, 7075, 2024 and 2124 the amount of time that I hold the metal depends upon the specific heat treatable alloy that I am rolling. My goal, however, is to create precipitation of intermetallic constituents that produce a dispersion of particles from 0.5 to 10 microns in size; these precipitates can act as recrystallization nuclei for new grains in later stages of the process and enhance the development of fine grains.

For example, to create superplastic properties in AA 7475, I employ a temperature of about 750° F. for a period of about 1 to 14 hours, typically about 8 hours. This step allows precipitates of intermetallic constituents, which are soluble in the aluminum at higher temperatures, to form and grow to sizes around ½ to 10 microns. These precipitates help to control the final grain size by acting as nuclei during the static recrystallization that occurs during the final annealing of the cold rolled sheet.

In contrast, non-heat treated alloys do not receive this heating step and hot rolling is continued. In these alloys, it is necessary to rely on other precipitates formed during the solidification of the ingot during casting, or at high temperatures in the homogenizing step, to help control the grain size.

Second Hot Rolling

For heat treatable alloys, I follow the over aging treatment with a second stage of hot rolling. In this step, I prefer to roll using conventional intermediate and continuous mills, but other mills could be used. I cool the metal rapidly as it passes through the mill, and it exits the mill at a temperature selected in reference to FIG. 2 This is an important part of the invention.

I can achieve the desired exit temperature by judicious selection of rolling speed, entry temperature, rolling lubricant/coolant flow rates, and by balancing the rolling reductions in each pass through the rolls. These control methods are well known to those skilled in the art of hot rolling.

If I maintain the exit temperature below the line A-B in FIG. 2, then I obtain grain sizes of less than about 15 microns, and good superplastic properties are possible for a particular degree of subsequent cold rolling. The line A-B in the example shown in FIG. 2 is drawn for the cooling conditions observed in a large coil of aluminum sheet when cooling from the exit (or coiling) temperature to room temperature. The exact position of the line will depend to some extent on the actual cooling rate and will of course be different for sheets or plates rolled individually and not coiled or stacked, and in this case it will also depend on the product thickness. The line may also be drawn for finer desired grain sizes, and better superplastic properties, at some level below the line A-B, or line A'-B'.

In contrast, for non-heat treated alloys, the second stage rolling is combined in with the initial stage for a single hot rolling step, or for convenience it may follow cooling and reheating to the second stage rolling temperature.

Cold Rolling

Following the cooling of the hot rolled material, the sheet may then be cold or warm rolled an amount of from 0 to 99%, either as coil or as individual sheets or plates to the desired gauge. Optimum superplastic properties are obtained when this amount of rolling follows the relationship shown in FIG. 2 with the exit temperature.

As with the non-heat treatable alloys, I unexpectedly discovered that the amount of cold rolling required to produce superplastic properties in the final product may be a function of or at least strongly dependent on the hot rolling exit or coiling temperature. I have determined that I obtain superplastic properties only by cold rolling to a gauge corresponding to a percentage of cold work which falls within the zone defined by the lines joining the points of A, B, C, and D as illustrated in FIG. 2. In addition, I have found that I obtain optimum superplastic properties when the amount of cold work falls within the zone defined by the line joining the points A', B', C and D. Again, as with the non-heat treatable alloys, for most conventional hot rolling processes, however, approximately 50% or more cold rolling is required to produce an annealed grain size below 10 to 15 microns, and to develop good superplastic properties. A principle advantage of my process is that by discovering the relationship between hot rolling exit temperature and the amount of cold work, I can significantly reduce the amount of cold work necessary to obtain the desirable superplastic properties as compared to conventional processes.

Final Annealing Step

As with non heat treated alloys, I can optionally use an anneal step to obtain an "O" or "T4" temper for heat treatable alloys. Cooling from the annealing temperature may be rapid, using for example a water quench, to produce a solution treated "T" temper product in alloys 7X75 or 2X24, or slow to produce an "O" temper product.

EXAMPLE 1

To demonstrate the present invention for producing superplastic properties in heat treatable alloys, I homogenized three ingots of AA 7475 alloy approximately 16 inches thick for 24 hours at 965° F. and then cooled them to room temperature; machined them to remove undesirable surface features ("scalped") and re-heated them for rolling at 800° F. I then hot rolled them on a reversing mill in the temperature range of 800° to 700° F. to a slab with a thickness of 6 inches at which gauge I allowed it to cool naturally to room temperature, that is at about 100° F./hr. Subsequently, I heated the slab to 760° F. and held it there for 8 hours at temperature, and transferred it back to the hot rolling mill where I rolled it in a reversing mill and then in a 5 stand continuous mill to a gauge of 0.25" and then I coiled it. By adjusting the cooling through the rolling sequence using techniques familiar to those familiar with the art of rolling, for example, lubricant flow volumes, mill speed, etc. it was possible for me to control the hot rolling exit temperature, which in this case was also the coiling temperature, and coiled each rolled ingot at different temperatures, specifically 580° F., 500° F. and 420° F.

Figure 4:
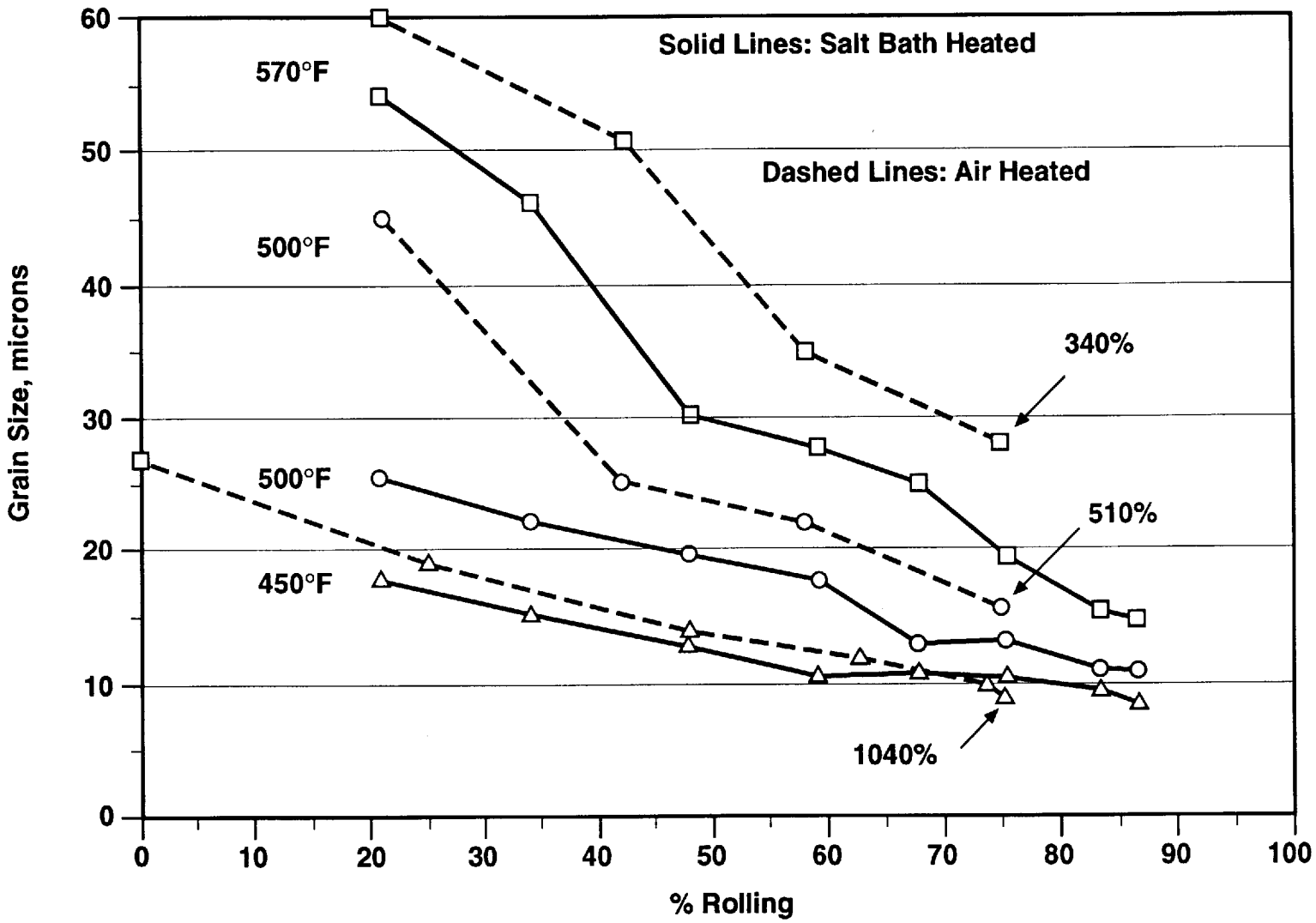
FIG. 4 is a graph showing the grain sizes developed in AA 7475 alloy sheet when processed according to the present invention.

After cooling the coils in air to room temperature at about 10 to 30 F/hr., I cold rolled sections in the same rolling directions to different gauges. I then flash heated the cold rolled sheets in a salt bath or in stirred air for 10 minutes approximately to recrystallize them and to obtain a fine grain size in each as illustrated in FIG. 4. I water quenched the sheets from the annealing temperature.

EXAMPLE 2

To demonstrate the present invention for producing superplastic properties in heat treatable alloys, I homogenized two scalped ingots of alloy AA5083, approximately 16 inches thick for 20 hours at 925° to 975° F. and hot rolled to strip in the continuously decreasing temperature range to 640° F. and 500° F. respectively, using the same temperature control techniques as in Example 1 above.

Figure 5:
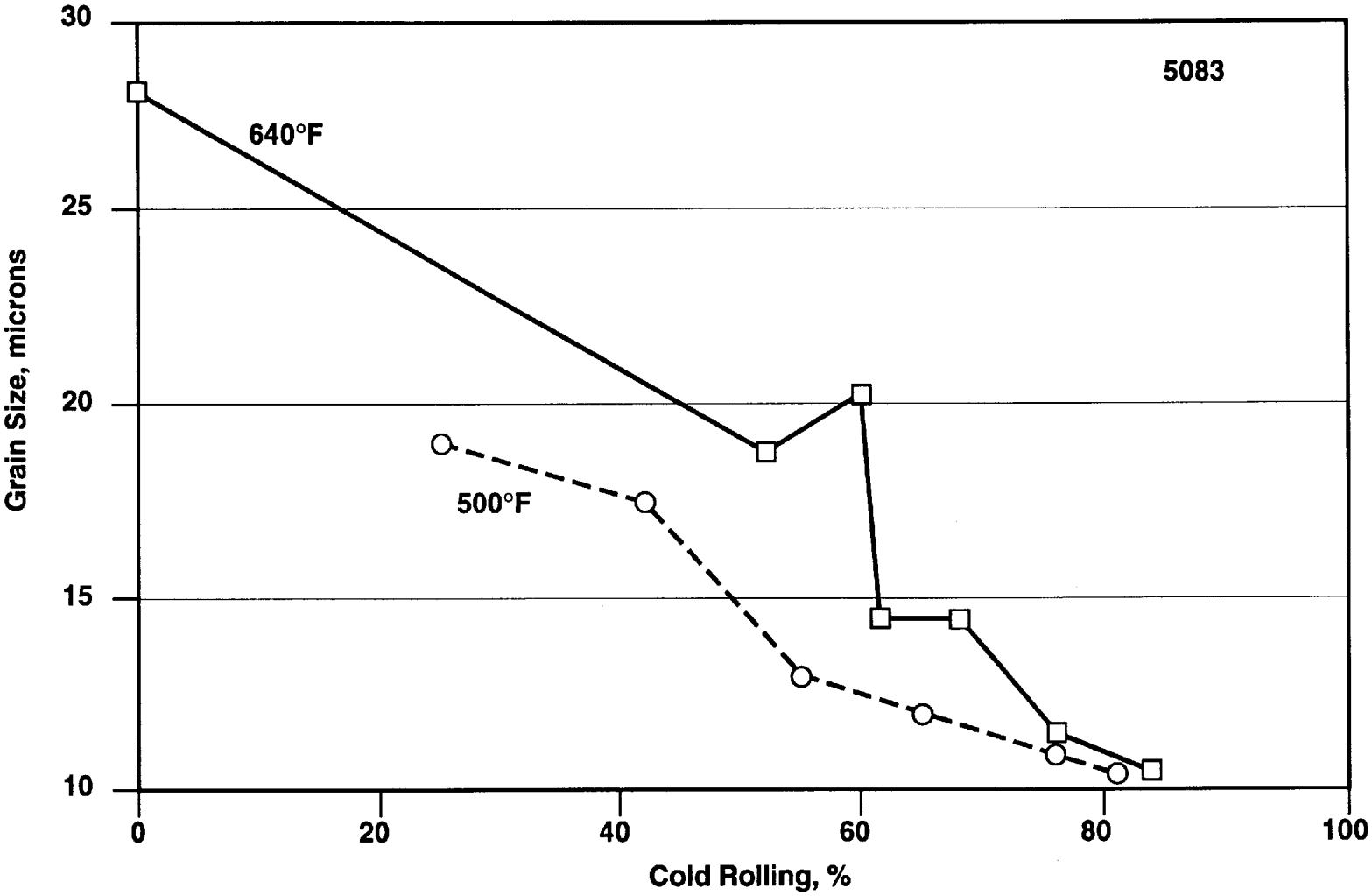
FIG. 5 is a graph showing the grain sizes developed in AA 5083 alloy sheet when processed according to the present invention.

Upon exiting the mill the strips, I immediately coiled them and allowed them to cool naturally to ambient temperature. I then cold rolled the coil various amounts up to about 84% as depicted in FIG. 5. I then rapidly heated these sections by salt bath annealing or by circulating air to recrystallize them, and then measured the grain size as shown if FIG. 5. I determined superplastic elongations by using longitudinal and transverse uniaxial tensile test specimens tested at a strain rate of $2\times10^{-4}$ and at a temperature of 1022° F. Elongations are also shown in FIG. 5.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A method of producing an aluminum alloy having superplastic properties, comprising the steps of:

(a) providing an aluminum alloy;

(b) hot rolling the alloy to a finishing temperature ranging from about 70° F. to 650° F., wherein the alloy is hot rolled at an initial temperature and then cooled rapidly during hot rolling to an exit temperature, the rapid cooling being adapted to retain as much strain energy in the metal as possible and to impede the loss of this energy by recrystallization and recovery; and (c) cold rolling to a gauge corresponding to a percentage of cold work selected from among those falling within the zone defined by the lines joining the points of A (475° F., 10%), B (650° F., 99%, C (70° F., 99%), and D (70° F., 10%) shown in FIG. 2, showing the relationship between the hot rolling exit temperature and the percent of cold work, thereby producing an aluminum alloy capable of having superplastic properties.

2. The method of claim 1 wherein the aluminum alloy is selected from the group consisting of the AA 3000 and AA 5000 series alloys.

3. The method of claim 1 wherein the alloy consists essentially of about 4.0 to 4.9 wt. % magnesium; about 0.4 to 1.0 wt. % manganese; not more than about 0.25 wt. % chromium; not more than about 0.4 wt. % iron; not more than about 0.4 wt. % silicon; and the balance aluminum.

4. The method of claim 1 wherein the heating comprises homogenizing the alloy at a temperature ranging from about 750° to 1100° F. for about 1 to 24 hours.

5. The method of claim 1 wherein the alloy is initially hot rolled at a temperature ranging from about 700° to 1000° F.

6. The method of claim 1 wherein the hot rolled alloy is cold rolled to a gauge corresponding to a percentage of cold work selected from among those falling within the zone defined by the lines joining the points of A' (350° F., 10%), B' (550° F., 99%), C (70° F., 99%) and D (70° F., 10%), shown in FIG. 2, showing the relationship between the hot rolling exit temperature and the percent of cold work.

7. The method of claim 1 further comprising annealing the cold rolled alloy, thereby producing an aluminum alloy having superplastic properties.

8. A method of producing an aluminum alloy having superplastic properties, comprising the steps of:

(a) providing a heat treatable aluminum alloy;

(b) heating the alloy;

(c ) initial hot rolling;

(d) holding at a temperature and time period sufficient to create precipitates of intermetallic constituents having a diameter ranging from about 0.5 to 10 microns;

(e) hot rolling to an exit temperature ranging from 70° F. to 650° F., wherein the alloy is hot rolled at an initial temperature and then cooled rapidly to an exit temperature, the rapid cooling being adapted to retain as much strain energy in the metal as possible and to impede the loss of this energy by recrystallization and recovery; and (f) cold rolling to a gauge corresponding to a percentage of cold work selected from among those falling within the zone defined by the lines joining the points of A (475° F., 10%), B (650° F, 99%), C (70° F., 99%), and D (70° F., 10%) shown in FIG. 2, showing the relationship between the hot rolling exit temperature and the percent of cold work, thereby producing an aluminum alloy capable of having superplastic properties.

9. The method of claim 8 wherein the heat treatable aluminum alloy is selected from the group consisting of the AA 2000 and AA 7000 series alloys.

10. The method of claim 8 wherein the heat treatable aluminum alloy consists essentially of about 5.2 to 6.2 wt. % zinc, about 1.9 to 2.6 wt. % magnesium, about 1.2 to 1.9 wt. % copper, and 0.18 to 0.28 wt. % chromium.

11. The method of claim 8 wherein the heat treatable aluminum alloy consists essentially of not more than about 6 wt. % copper, not more than about 2 wt. % magnesium, the balance being essentially aluminum and impurities.

12. The method of claim 8 wherein the initial hot rolling comprises hot rolling at a temperature ranging from about 700° to 1000° F.

13. The method of claim 8 wherein the initially hot rolled alloy is held at a temperature ranging from about 650° to 850° F. for at least 2 hours.

14. The method of claim 8 wherein the hot rolled alloy is cold rolled to a gauge corresponding to a percentage of cold work selected from among those falling within the zone defined by the lines joining the points of A (475° F., 10%), B (650° F., 99%), C (70° F., 99%) and D (70° F., 10%), shown in FIG. 2, showing the relationship between the temperature range of the hot rolling exit temperature and the percent of cold work.

15. The method of claim 8 further comprising annealing the cold rolled alloy, thereby producing an aluminum alloy having superplastic properties.

* * * * *